US005211584A

United States Patent [19]

Lee

[11] Patent Number: 5,211,584

[45] Date of Patent: May 18, 1993

[54] PLUG-IN ELECTRICAL RECEPTACLE

[76] Inventor: James Lee, 5th Fl., No. 10, Alley 10, Lane 321, Hsinming Rd., Neihu Dist., Taipei, Taiwan

[21] Appl. No.: 899,349

[22] Filed: Jun. 16, 1992

Related U.S. Application Data

[63] Continuation-in-part of Ser. No. 788,246, Nov. 5, 1991, Pat. No. 5,122,082.

[51] Int. Cl.[5] ..... H01R 13/00

[52] U.S. Cl. ..... 439/652

[58] Field of Search ..... 439/650–655

[56] References Cited

U.S. PATENT DOCUMENTS

D. 315,718 3/1991 Luu .
D. 318,849 8/1991 Luu .
D. 324,029 2/1992 Luu .
3,005,179 10/1961 Holt .
4,934,962 6/1990 Luu et al. .
5,004,435 5/1991 Jammet .
5,071,367 12/1991 Luu .

*Primary Examiner*—Joseph H. McGlynn
*Attorney, Agent, or Firm*—Merchant, Gould, Smith, Edell, Welter & Schmidt

[57] ABSTRACT

A multiple electrical receptacle unit adapted to be attached to a wall-mounted receptacle has a housing including a plurality of prong-receiving apertures penetrating the housing and a perimetric edge defining a wall-facing opening; a coupling means including a back plate which is integral with a plurality of pods as well as a plurality of spacers situated between the back plate and the pods, and a plurality of plugs having prongs projecting through the back plate for engagement in a wall receptacle. The coupling means is received within the perimetric edge of the housing to define a space between the plate and the housing, and the pods are within the housing adjacent to the apertures. Each pod encases a plurality of contact strips, and each strip is aligned with at least two of the apertures of the housing and is electrically connected to the prong of the plug.

16 Claims, 5 Drawing Sheets

PLUG-IN ELECTRICAL RECEPTACLE

This is a Continuation-In-Part patent application of the issued patent, U.S. Pat. No. 5,122,082, filed on Nov. 5, 1991, and issued on June 16, 1992.

BACKGROUND OF THE INVENTION

The present invention relates to electrical plug receptacle units and particularly to multiple electrical plug receptacle units adapted to be attached to a wall-mounted receptacle.

As shown in FIG. 1, a conventional electrical plug receptacle adapter unit generally comprises a housing 4 having a plurality of prong-receiving apertures 40 penetrating the housing 4 and a perimetric edge defining a wall-facing opening. A plurality of pods 41 are fixed within the housing 4 adjacent to the plurality of apertures 40, each pod 41 encasing a plurality of contact strips 42, and each strip 42 being aligned with at least two of the apertures 40. Each pod 41 includes a plurality of tabs 45 on an outward facing side thereof. A back plate 3 received within the perimetric edge of the housing 4 to define a space between the back plate 3 and the housing 4. The back plate 3 includes a plurality of prongs 32 projecting through slots 30 of the back plate 3 and a plurality of partitions 31 for dividing the prongs 32. The housing 4 further includes a plurality of linear webs 43 for engaging the tabs 45 of the pods 41 and a plurality of J-shaped webs 44 for receiving the pods 41 at predetermined positions.

To assemble a conventional electrical plug receptacle adapter unit requires a number of procedures, which can be obviated, such as by positioning the pods 41 into the housing 4 and positioning the partitions 31 and prongs 32 into the back plate 3.

It is the purpose of this present invention, therefore, to mitigate and/or obviate the above-mentioned drawbacks in the manner set forth in the detailed description of the preferred embodiment.

SUMMARY OF THE INVENTION

It is an object of the present invention to provide a multiple electrical plug adapter unit comprising a back plate which is integral with a plurality of pods for decreasing the number of procedures in assembling an electrical plug adapter unit.

These and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Figure 1:
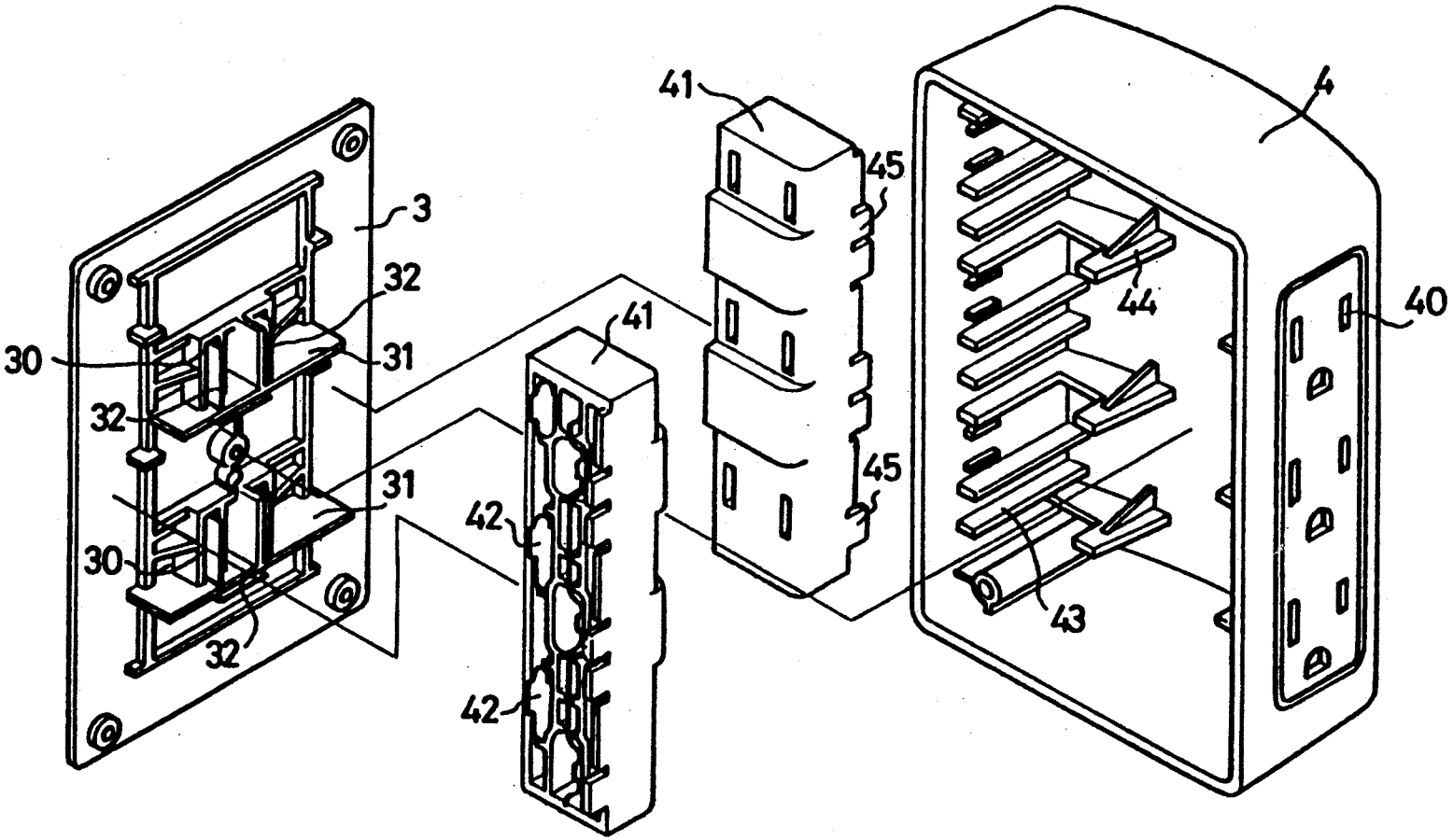
PRIOR ART FIG. 1
FIG. 1 is an exploded perspective view of a prior electrical plug receptacle adapter unit.
Figure 2:
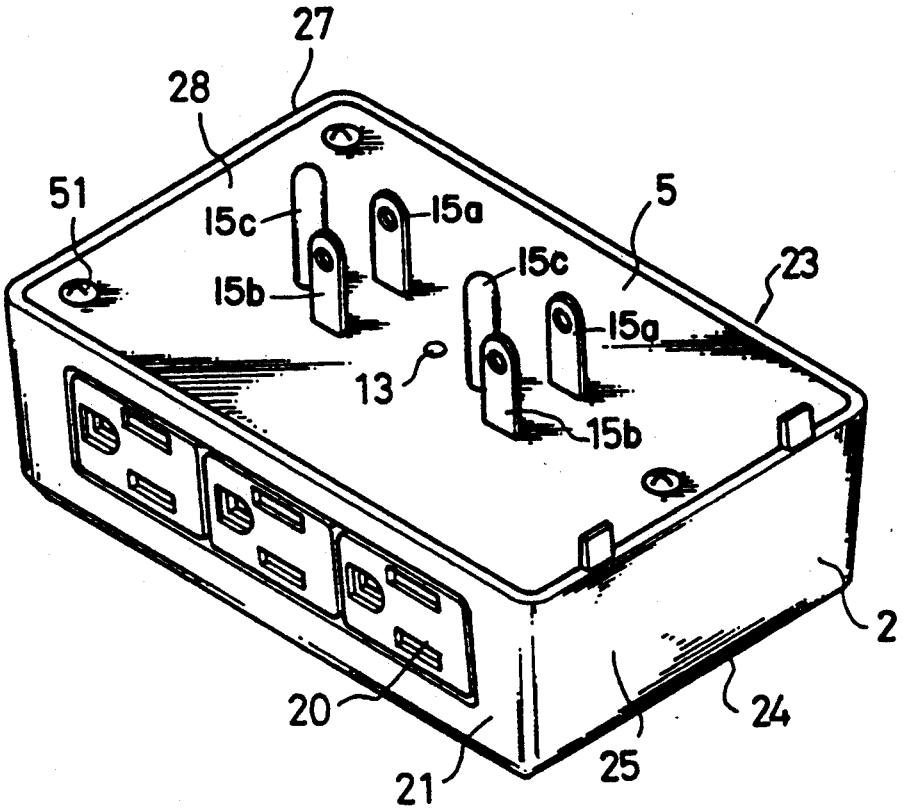
FIG. 2 is a perspective view of a back, a side, and an end of an electrical plug receptacle adapter unit in accordance with the present invention.
Figure 3:
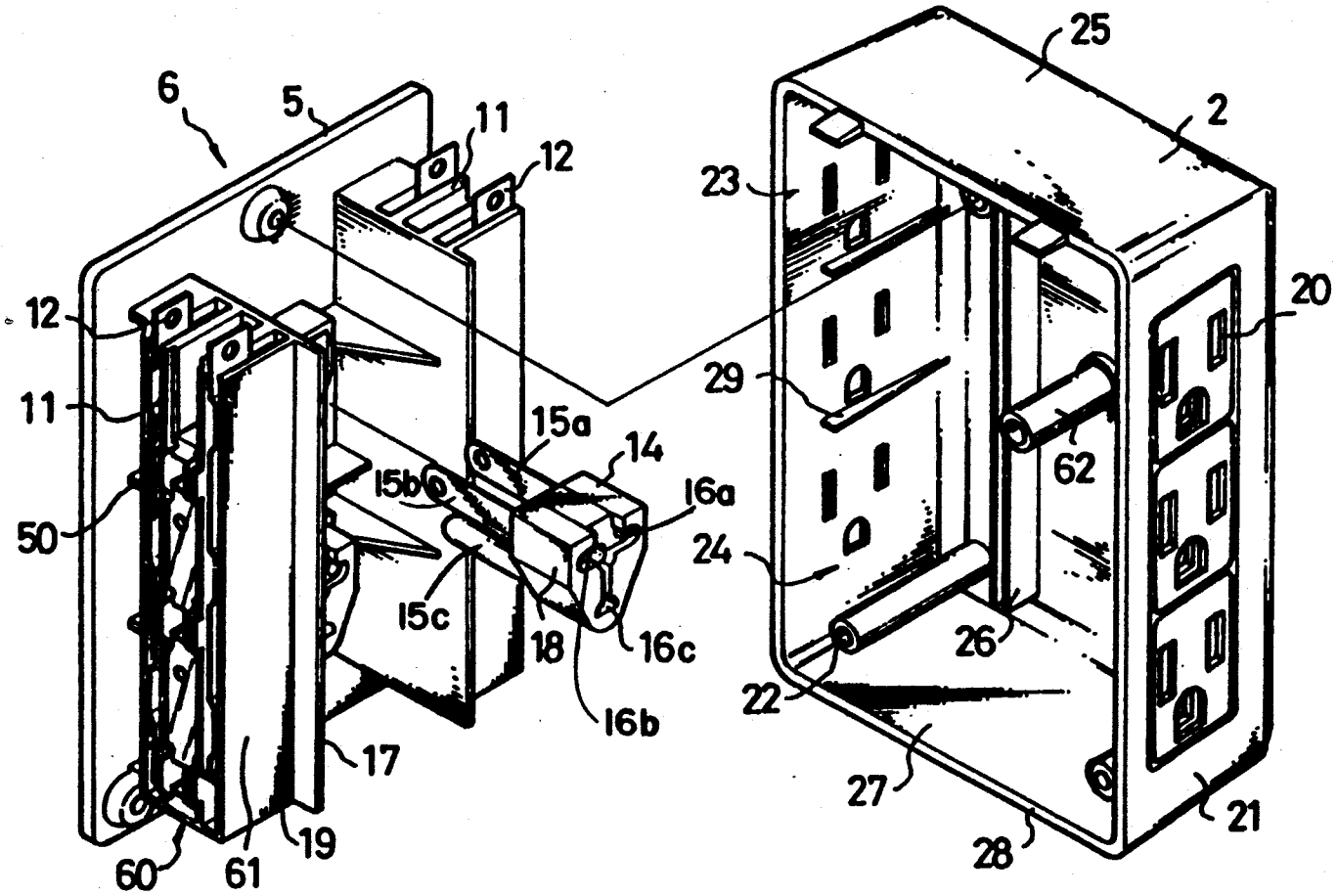
FIG. 3 is an exploded perspective view of the receptacle adapter unit shown in FIG. 1.

As shown in FIGS. 2 and 3, an electrical plug receptacle adapter unit 1 comprises a housing 2 which has a front panel 24, side panels 21 and 23, and end panels 25 and 27. The side panels 21 and 23 together with the end panels 25 and 27 extend rearwardly from the front panel 24 to a perimetric edge 28 which defines a rearward or wall-facing opening. A plurality of apertures 20 for receiving prongs of electrical plugs (not shown) are situated on both side panels 21 and 23.

A coupling means 6 comprises a back plate 5 which is integral with a pair of identical pods 10 as well as a plurality of spacers 50, and two plugs 14. The spacers 50 are situated between the back plate 5 and the pods 10 to distance the two elements. The coupling means 6 is received within the perimetric edge 28 of the housing 2, wherein the back plate 5 is generally parallel to but spaced from the front panel 24. Each pod 10 generally comprises a unitary block 19 of electrically insulative material having a plurality of slots 11 spaced from each other on an outward facing surface 60 thereof. Each unitary block 19 has a strip 17 projecting from the inner side of a forward facing surface 61 of pod 10. A plurality of contact strips 12 are situated in slots 11 of pods 10. Each plug 14 comprises a casing 18 and prongs **15*a*, 15*b* and 15*c* projecting through the back plate 5 for engagement in a wall receptacle (not shown). The casing 18 includes three penetrating holes 16*a*, 16*b* and 16*c* for receiving flexible electrical conductors 70 which connect each of the strips 12 to one of the prongs 15*a* or 15*b* or 15*c*, so that each pod 10 is independently connected to only one of the duplex receptacles to which the adapter unit 1 may be inserted. Fasteners 51 secure the back plate 5 to the housing 2**.

Figure 4:
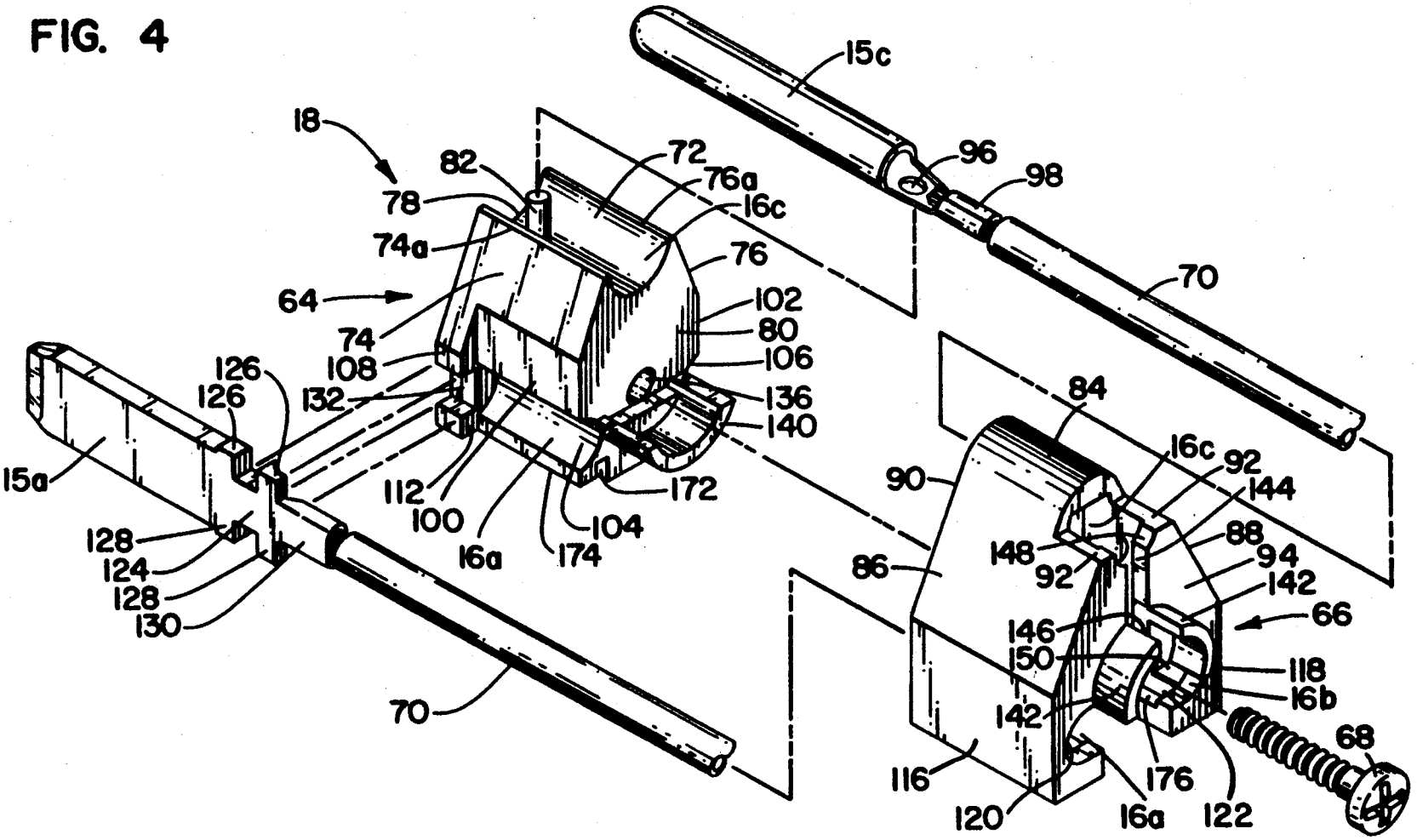
FIG. 4 is an exploded perspective view of an embodiment a plug casing.

An embodiment of the plug casing 18 is shown is FIG. 4. In this figure, only the prongs **15*a*, 15*c* are shown. The prong 15*b* which is identical to the prong 15*a*is not shown for purpose of illustration. Further in this figure, only the holes 16*a*, 16*c* are shown. The hole 16*b* which is identical to the hole 16*a*** is not shown for the same reason.

In the embodiment, as shown in FIG. 4, the casing 18 includes inner portion 64 and outer portion 66 which are mounted together by a screw 68. The inner portion 64 comprises a top concave surface 72 defined by two oblique side walls 74, 76. The top concave surface 72 extends longitudinally along two edges **74*a* and 76*a*, which are defined between the top concave surface 72 and the oblique side walls 74, 76, respectively, toward a vertical front side wall 78 and a vertical back side wall 80. The outer portion comprises a top convex surface 84 which is defined by two oblique side walls 86, 88. The top convex surface 84 extends longitudinally toward a vertical front side wall 90, and toward two horizontal edges 92 which further extends to a vertical back side wall 94. The inner portion 64 and the outer portion 66 are attached together by sliding the inner portion 64 into the outer portion 66 along the edges 74*a* and 76*a*. Back ends of the edges 74*a* and 76*a* are engaged with the horizontal edges 92 of the outer portion 66. The back side wall 80 of the inner portion 64 is engaged with the back side wall 94, while the oblique side walls 74, 76 of the inner portion are engaged with the oblique side walls 86, 88, respectively. The hole 16*c* is therefore defined between the top concave surface 72** of the inner portion 64 and the top convex surface 84 of the outer portion 66.

A cylindrical projection 82, which is integral with the top concave surface 72, is projected upward from the bottom surface the top concave surface 72 to the same height as the oblique side walls 74, 76. The prong 15c is secured to the top concave surface 72 by the cylindrical projection 82 passing through a hole 96 which is substantially disposed on a back end of the prong 15c. Since the cylindrical projection 82 is close to the front side wall 78, the prong 15c is projected from the hole 16c. The conductor 70 is mounted on the back end of the prong 15c by a securing member 98 which is extended back from the hole 96. Accordingly, the back end of the prong 15c with the hole 96 and the securing member 98, and a part of the conductor 70 with insulate sheath are located in the hole 16c defined between the top concave surface 72 and the top convex surface 84. The size of the conductor 70 with insulate sheath fits the dimension of the hole 16c so that the prong 15c is fixedly secured to the hole 16c.

In addition, the oblique side walls 74, 76 are extended downward to reach two vertical side walls 100, 102. Bottom sides of the vertical side walls 100, 102 connect to two vertical side concave surfaces 104, 106, respectively. The vertical side walls 100, 102 and the vertical side concave surfaces 104, 106 extend horizontally to the back side wall 80, and extend to the front side wall 78 to reach two side-facing recesses 132 at the ends of the extension. Only one of the recesses 132 is shown in FIG. 4 as the other recess is on a side not shown. The side-facing recesses 132 are respectively defined between extensions 108 of the oblique walls 74, 76, which are on the front side wall 78, and projections 112 of the front side wall 78. The outer portion 66 further comprises two vertical side walls 116 and 118 which are extended from bottom edges of the oblique side walls 86, 88, respectively. Two vertical concave surfaces 120, 122 are disposed in the inner side surface of the vertical side walls 116, 118. When the outer portion 66 slides over the inner portion 64, the holes 16a, 16b are defined between the vertical side concave surfaces 104, 106 of the inner portion 64 and the inner surface of the vertical side walls 116, 118 of the outer portion 66. The side surfaces of the extensions 108 and the side surface of the projections 112 are engaged to the inner surfaces of the vertical side walls 116, 118. Further, two grooves 172 are oppositely disposed near side edges of a bottom surface 174. Two ridges 176 corresponding to the grooves 172 are disposed on two flat surfaces which respectively project from the inner side surface of vertical side walls 116, 118. The ridges 176 extend vertically along the flat surfaces and are integral with the vertical concave surfaces 120, 122. The flat surfaces are not shown in FIG. 4 for purposes of illustration. Accordingly, when the outer portion 66 slides over the inner portion 64, the ridges 176 are engaged with the grooves 172.

The prong 15a comprises a middle portion 124, two spaced-apart upper projections 126 and two spaced-apart lower projections 128 at substantially the back end of the prong 15a. The middle portion 124, the upper projections 126 and the lower projections 128 forms an "H" shape structure in which the horizontal web of the "H" is the middle portion 124. The conductor 70 is mounted on the back end of the prong 15a by a securing member 130.

The middle portion 124 of the prong 15a is disposed in the recesses 132. The upper and lower projections 126, 128 are fixedly secured to the extensions 108 and the projections 112, respectively. The back end of the prong 15a with the "H"-shape structure and the securing member 130, and a part of the conductor 70 with the insulate sheath are located in the hole 16a. The size of the conductor 70 with insulate sheath fits the dimension of the hole 16a so that the prong 15a is fixedly secured to the hole 16a defined between the vertical side concave surface 104 and the inner side surface of the vertical side walls 116.

Additionally, the inner portion 64 further comprises a hole 136 in the middle of the inner portion passing through the back side wall 80 and the front side wall 78, and a concave projection 140 projected from the back side wall 80 of the inner portion 64. The outer portion 66 further comprises two arch-shape projections 142 projected from the back side wall 94 of the outer portion 66. The arch-shape projections 142 are symmetrical along the longitudinal axis of the outer portion 66. A notch 144, which aligns with an opening 146 defined between the arch-shape projections 142, is disposed in the middle of the back side wall 80. The notch 144 is extended upward to reach two concave surfaces 148 which are further connected to the side of the horizontal edges 92. When the outer portion 66 slide over the inner portion 64, two arch-shape projections 142 vertically align with the projection 140 and form an opening 150. The hole 136 is disposed inside the opening 150. The screw 68 attaches the inner portion 64 to the outer portion 66 by passing through the hole 136 and fixedly mounting on a threaded recess 152 on the back plate 5 (see FIG. 5).

Figure 5:
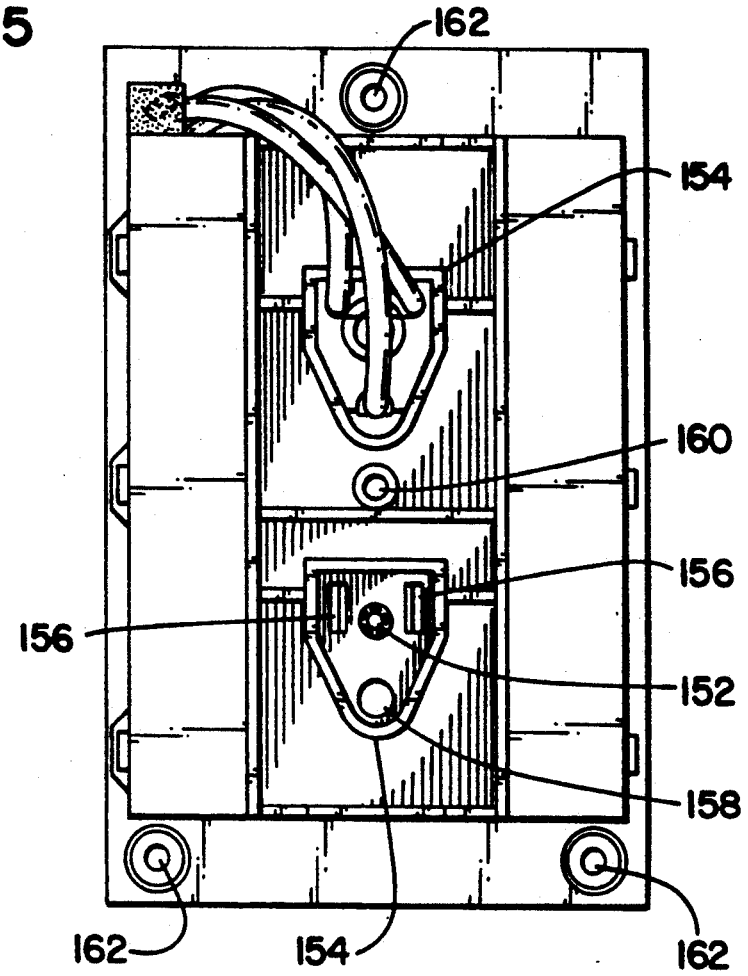
FIG. 5 is a plane view of an inner surface of the back plate showing one of the plug casings removed.

In an embodiment shown in FIG. 5, two structures 154 project and are integral with the back plate 5. Two holes 156 in the structures 154 receive the prongs 15a, 15b so that the prongs 15a, 15b project through the back plate 5. A hole 158 in the structures 154 receives the prong 15c so that the prong 15c projects through the back plate 5. In a preferred embodiment shown in FIG. 5, the prongs 15a, 15b and the holes 156 are rectangular shape. The prong 15c and the hole 158 are round shape. As shown in FIG. 5, one plug 4 having three conductors 70 connected at one end of the conductors 70 is plugged into one of the structures 154 so that the plug 4 projects through the back plate 5. Another end of three conductors 70 connect to three strips 17 on the pods 10. Another empty structure 154 is illustrated in FIG. 5 so as to show the preferred shape of the recesses 156, 158 and the structure 154.

The housing 2 further includes a plurality of webs 29, which are integral with the side panels 21 or 23, are provided to position pods 10. Two pairs of strips 26, which are integral with the front panel 24, are provided to couple with the strips 17 of the pods 10. The housing 2 additionally has fastener receiving standoffs 22 for receiving the fasteners 51 which secure the back plate 5 to the housing 2. Additionally, a centrally situated sleeve 62 is provided from the front panel 24 of the housing 2 for securing the back plate to the housing 2 through a central aperture 13.

Further in the embodiment as shown in FIG. 5, three recesses 162 receive three standoffs 22 so as to secure the back plate 5 to the housing 2 by the fasteners 51. In addition, a recess 160 receives the central sleeve 62 of the front panel 24 so as to secure the back plate to the housing 2 through the central aperture 13.

Figure 6:
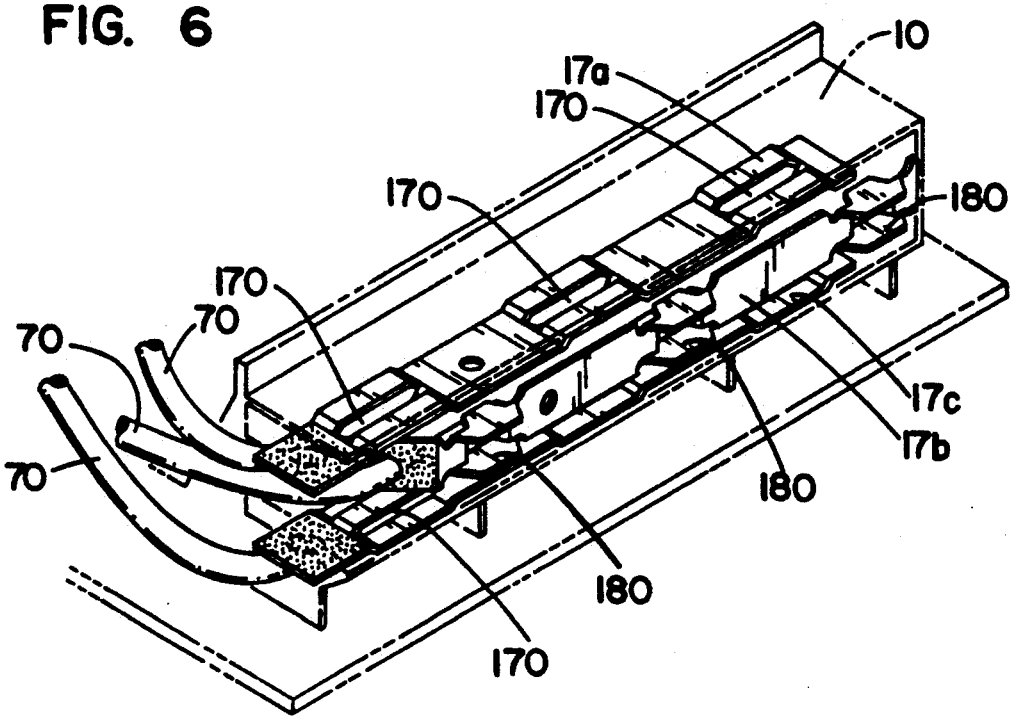
FIG. 6 is an enlarged perspective view of an embodiment of a pod with the electrically conductive strips disposed therein.

An embodiment of a pod with the electrically conductive strips disposed therein is shown in FIG. 6. Strips 17*a*, 17*c* are positioned in the top and bottom slots 11, respectively. Strip 17*b* is positioned on the outward facing surface 60. A couple of apertures 170 which are disposed on the strips 17*a*, 17*c* receive two side prongs of incoming plug. An aperture 180 which is disposed on the strip 17*b* receives one middle prong of incoming plug. In a preferred embodiment as shown in FIG. 6, three pairs of apertures 170 and three corresponding apertures 180 are used for three incoming plugs. Further, three conductors 70 are electrically connected to three strips 17*a*, 17*b* and 17*c*, respectively. The conductor 70 in the middle connects the strips 17*b* to the prong 15*c* The conductors 70 on the opposite sides respectively connect the strips 17*a*, 17*c* to the prongs 15*a*, 15*b*.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A multiple electrical plug receptacle adapter unit intended for attachment to a wall-mounted electrical plug receptacle comprising:

a housing including a plurality of prong-receiving apertures penetrating said housing, and a perimetric edge defining a wall-facing opening; and a coupling means for coupling the housing to the wall-mounted electrical plug receptacle including a back plate which is integral with a plurality of pods, and a plurality of plugs, each plug having prongs for engagement in the wall-mounted electrical plug receptacle, said coupling means being received by said housing so as to define a space between said plate and the housing, said pods being within said housing adjacent to said apertures, each pod encasing a plurality of contact strips, each strip being aligned with at least two of said apertures; and each pod further comprising flexible means for electrically connecting each contact strip to one prong of said plugs.

2. An adapter unit as claimed in claim 1, wherein each plug includes a casing having three penetrating holes receiving said flexible means.

3. An adapter unit as claimed in claim 1, wherein said coupling means includes a plurality of spacers situated between said back plate and said pods which are integral with each other.

4. An adapter unit as claimed in claim 1, wherein said plugs are threadedly secured to the back plate.

5. An adapter unit as claimed in claim 1, wherein said back plate is received within said perimetric edge of said housing.

6. An adapter unit as claimed in claim 1, wherein said housing includes a front panel generally parallel to said back plate, and side panels extending rearwardly from said front panel to said perimetric edge, said plurality of prong-receiving apertures being confined to said side panels.

7. An adapter unit as claimed in claim 6, wherein said housing includes a plurality of webs for positioning said pods with respect to said plug-receiving apertures.

8. An adapter unit as claimed in claim 1, wherein each pod comprises a unitary block of insulative material having a plurality of slots spaced from each other on an outward facing surface and having a strip projecting from a forward facing surface of said pod.

9. An adapter unit as claimed in claim 8, wherein said housing includes at least two pairs of strips, which are integral with said front panel of said housing, for coupling with said strips of said pods.

10. A multiple electrical plug receptacle adapter unit intended for attachment to a wall-mounted electrical plug receptacle comprising:

a housing including a plurality of prong-receiving apertures penetrating said housing, and a perimetric edge defining a wall-facing opening; and a coupling means for coupling the housing to the wall-mounted electrical plug receptacle including a back plate, a plurality of pods, and a plurality of plugs; said back plate being received by said housing so as to define a space between said back plate and the housing, said pods being within said housing adjacent to said apertures, each pod encasing a plurality of contact strips, each strip being aligned with at least two of said apertures;

each pod further comprising flexible means for electrically connecting each contact strip to one prong of said plugs; and said plugs including a plurality of prongs and a plug casing having an inner portion coaxially received within an outer portion, the plug casing being threadedly attached to the back plate by a threaded member.

11. An adapter unit as claimed in claim 10, wherein said two prongs each includes an "H"-shape structure for fixedly securing said prongs to a couple of recesses in said inner portion.

12. An adapter unit as claimed in claim 10, wherein said inner portion includes a top concave surface for receiving one of said prongs, oblique side walls, side vertical concave walls for receiving two of said prongs, and a through hole in the middle portion of said inner portion receiving the threadedly member.

13. An adapter unit as claimed in claim 12, wherein said inner portion further comprises a couple of side recesses for receiving two of said prongs.

14. An adapter unit as claimed in claim 10, wherein said outer portion includes a top convex surface aligning with said top concave surface of said inner portion for receiving one of said prongs, oblique side walls attaching to said oblique side walls of the inner portion, side vertical walls aligning with said side vertical concave walls of the inner portion for fixedly securing said two prongs, and an opening aligning with the hole of said inner portion.

15. An adapter unit as claimed in claim 14, wherein said outer portion slides over said inner portion so that said prongs are fixedly retained in a plurality of holes defined between said inner portion and said outer portion.

16. An adapter unit as claimed in claim 14, wherein said threaded member passes through said opening and said hole and is threadedly attached to said back plate.

* * * * *